US008601644B1

(12) United States Patent
Chen et al.

(10) Patent No.: US 8,601,644 B1
(45) Date of Patent: Dec. 10, 2013

(54) DEVICE FOR INSTALLING DAMPING MEMBER TO HINGE UNIT

(75) Inventors: Ken-Ching Chen, Kaohsiung (TW); Hsiu-Chiang Liang, Kaohsiung (TW); Ting-Tsai Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 13/608,051

(22) Filed: Sep. 10, 2012

(51) Int. Cl.
*E05F 1/08* (2006.01)

(52) U.S. Cl.
USPC ..... 16/286; 16/54

(58) Field of Classification Search
USPC ..... 16/286, 287, 288, 54, 56, 366, 370, 16/371, 354; 188/282.1, 282.2, 381, 266, 188/283, 280, 281
See application file for complete search history.

(56) References Cited

U.S. PATENT DOCUMENTS

| | | | | |
|---|---|---|---|---|
| 6,684,453 | B2 | 2/2004 | Wang | |
| 7,096,535 | B2 | 8/2006 | Lin | |
| 7,406,749 | B2 * | 8/2008 | Herper | 16/368 |
| 7,562,416 | B2 * | 7/2009 | Lautenschlager et al. | 16/286 |
| 7,669,285 | B2 * | 3/2010 | Gallasch et al. | 16/286 |
| 8,205,298 | B2 | 6/2012 | Lin et al. | |
| 2005/0177980 | A1 * | 8/2005 | Herper | 16/366 |
| 2008/0109987 | A1 * | 5/2008 | Chen et al. | 16/68 |
| 2008/0168620 | A1 * | 7/2008 | Hammerle | 16/85 |
| 2011/0154609 | A1 * | 6/2011 | Liao | 16/54 |

FOREIGN PATENT DOCUMENTS

| | | | |
|---|---|---|---|
| DE | 102011050053 | A1 * | 11/2012 |
| EP | 2278104 | A1 * | 1/2011 |
| WO | WO 2005108726 | A1 * | 11/2005 |

* cited by examiner

*Primary Examiner* — Chuck Mah
(74) *Attorney, Agent, or Firm* — Rosenberg, Klein & Lee

(57) ABSTRACT

A hinge unit includes a hinge arm which defines a room in which a securing frame is installed. The securing frame includes two side panels with an engaging member connected therebetween. Each of the two side panels has an engaging portion on the inside thereof. The engaging member has a through hole and a protrusion extends from the periphery of the through hole. A damper has a body and a piston. The body has a front end portion having a recessed area, and a rear end portion having a protrusion. A fixing member connects the securing frame to the hinge arm. The piston extends through the through hole and the protrusion is engaged with the recessed area, the body of the damper is installed between the two side panels. The contact portion of the body contacts the engaging portion.

10 Claims, 5 Drawing Sheets

DEVICE FOR INSTALLING DAMPING MEMBER TO HINGE UNIT

FIELD OF THE INVENTION

The present invention relates to a device for installing a damping member to a hinge unit, and more particularly, to a device for increasing buffering feature of the hinge unit.

BACKGROUND OF THE INVENTION

U.S. Pat. No. 6,684,453 B2, U.S. Pat. No. 7,096,535 B2 and U.S. Pat. No. 8,205,298 B2 disclose a buffer or damping member connected between two hinging members such as the hinge base and the hinge arm so as to provide damping force when the hinge arm is pivoted relative to the hinge base. Generally, when installing the hinge, the hinge base is fixed to the cabinet and the hinge arm is connected to the door which is pivoted relative to the cabinet between the closed position and the opened position. After a period of time of use, the damping material may leak out from the damping member, so the buffering feature fails and this is difficult to fix by replacing a new damper in the damping member.

U.S. Patent Publication No. 2008/0168620 A1 discloses an attached damper which improves the shortcoming mentioned above, but the damper is exposed and occupies a space as well as affects the aesthetic feature.

The present invention intends to provide a device which installs the damper in the hinge unit and the damper can be replaced conveniently.

SUMMARY OF THE INVENTION

The present invention relates to a hinge unit comprises a hinge base having two wings and a housing is connected between the two wings. A hinge arm is pivotably connected to the hinge base and has two side walls and a bottom wall connected between the two side walls. Each side wall has a first connection hole and a second connection hole. The two side walls and the bottom wall define a room. A securing frame has two side panels and an engaging member is connected between the two side panels. Each of the two side panels has a first connection portion, a second connection portion and an engaging portion. The first connection portion is engaged with the first connection hole of the hinge arm. The second connection portion is located corresponding to the second connection hole of the hinge arm. The engaging portion is located on the inside of the side panels corresponding thereto and adjacent to the second connection portion. The engaging member has a through hole and a protrusion extends from the periphery of the through hole. A fixing member extends through the second connection hole of the hinge arm and the second connection portion of the securing frame so as to connect the securing frame to the hinge arm. A damper has a body and a piston. The body has a front end portion and a rear end portion. The front end portion has a recessed area and the rear end portion has a contact portion. The piston is axially movable relative to the body of the damper. The damper is connected between the two side panels of the securing frame. The piston extends through the through hole of the engaging member. The protrusion of the engaging member is engaged with the recessed area of the body. The contact portion of the body contacts the engaging portion of the side panels.

Preferably, the engaging member of the securing frame has an opening which communicates with the through hole and the protrusion extends toward the engaging portion.

Preferably, the contact portion of the damper is engaged with the engaging portion of the securing frame by an engagement relationship of protrusion and recess.

Preferably, the recessed area of the damper has a tubular portion which extends into the through hole of the engaging member.

Preferably, a connection member is located in the room of the hinge arm and the securing frame is connected in the connection member.

Preferably, the first connection portion is a protrusion.

Alternatively, the present invention provides a hinge unit and comprises a hinge base having two wings and a housing is connected between the two wings. A hinge arm is pivotably connected to the hinge base and has two side walls. A bottom wall is connected between the two side walls. Each side wall has a first connection hole and a second connection hole. The two side walls and the bottom wall define a room. A connection member is located in the room of the hinge arm. A securing frame is installed in the room of the hinge arm. The securing frame has two side panels and an engaging member is connected between the two side panels. Each of the two side panels has a first connection portion, a second connection portion and an engaging portion. The first connection portion is a protrusion and engaged with the first connection hole of the hinge arm. The engaging portion is located on the inside of the side panels corresponding thereto and adjacent to the second connection portion. The engaging member has a through hole and a protrusion extends from the periphery of the through hole. A fixing member extends through the second connection hole of the hinge arm and the second connection portion of the securing frame so as to connect the securing frame to the hinge arm. A damper has a body and a piston. The body has a front end portion and a rear end portion. The front end portion has a recessed area with which the protrusion of the securing frame is engaged. The rear end portion has a contact portion. The piston extends through the through hole of the engaging member and is axially movable relative to the body of the damper. The contact portion of the body contacts the engaging portion of the side panels.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
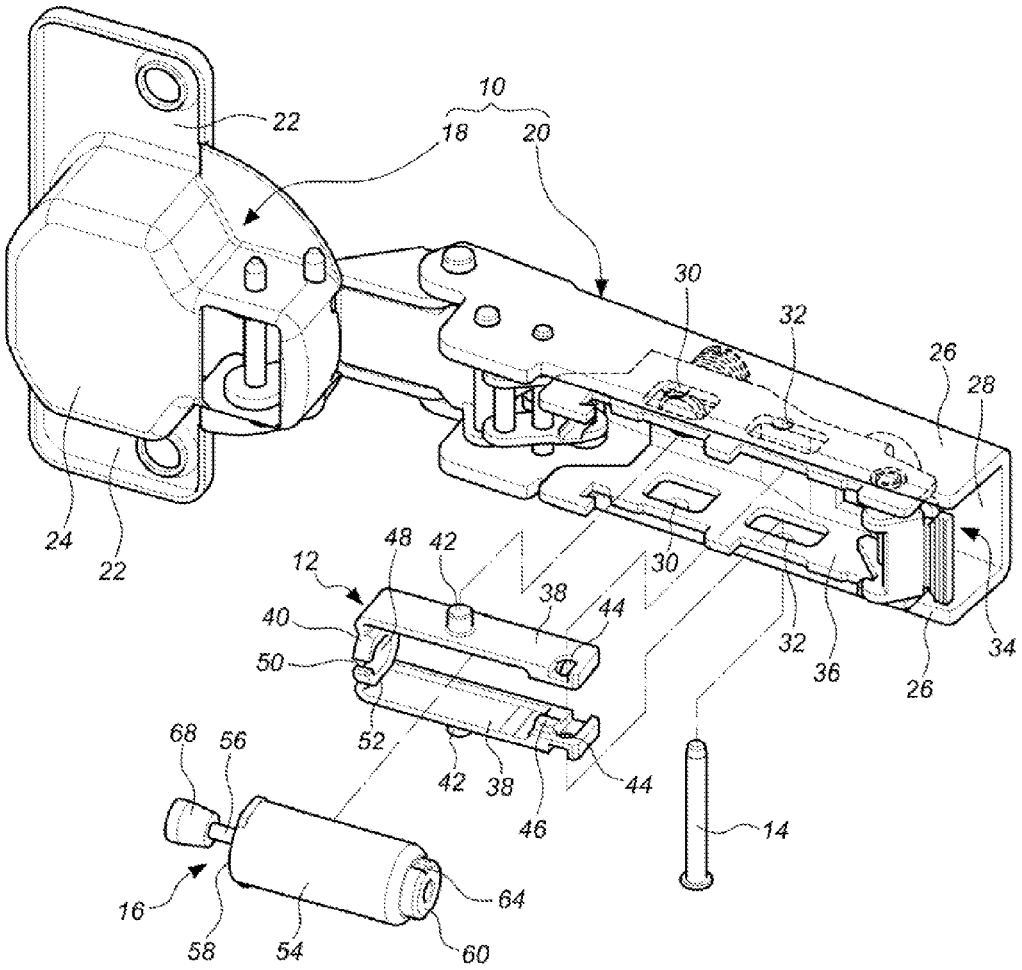
FIG. 1 is an exploded, view to show the hinge unit of the present invention.

Referring to FIG. 1, the present invention comprises a hinge unit 10, a securing frame 12, a fixing member 14 and a damper 16.

The hinge unit 10 comprises a hinge base 18 and a hinge arm 20. The hinge base 18 has two wings 22 and a housing 24 is connected between the two wings 22. The hinge arm 20 is pivotably connected to the hinge base 18 and has two side walls 26 and a bottom wall 28 is connected between the two side walls 26. Each side wall 26 has a first connection hole 30 and a second connection hole 32. The two side walls 26 and the bottom wall 28 define a room 34. A connection member 36 is installed in the room 34 of the hinge arm 20.

The securing frame 12 is installed in the connection member 36 in the room 34 of the hinge arm 20 and comprises two side panels 38 and an engaging member 40 connected between the two side panels 38. Each of the two side panels 38 has a first connection portion 42, a second connection portion 44 and an engaging portion 46. The first connection portion 42 is engaged with the first connection hole 30 of the hinge arm 20, and the second connection portion 44 is located corresponding to the second connection hole 32 of the hinge arm 20. The engaging portion 46 is located on the inside of the side panels 38 corresponding thereto and adjacent to the second connection portion 44. The engaging member 40 has a through hole 48, an opening 50 communicating with the through hole 48, and a protrusion 52 extending from a periphery of the through hole 48. The protrusion 52 extends toward the engaging portion 46. In a preferred embodiment, the first connection portion 42 is a protrusion and the second connection portion 44 is a hole.

The fixing member 14 extends through the second connection hole 32 of the hinge arm 20 and the second connection portion 44 of the securing frame 12 so as to connect the securing frame 12 to the hinge arm 20. By the connection between the first connection portion 42 and the first connection hole 30, the securing frame 12 is fixed to the inside of the connection member 36.

Figure 2:
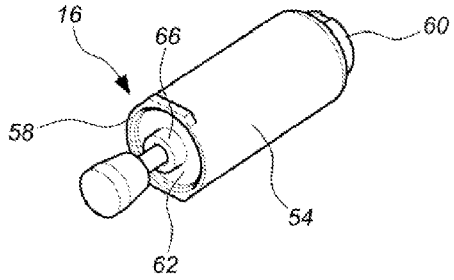
FIG. 2 is a perspective view to show the damper of the hinge unit of the present invention.
Figure 3:
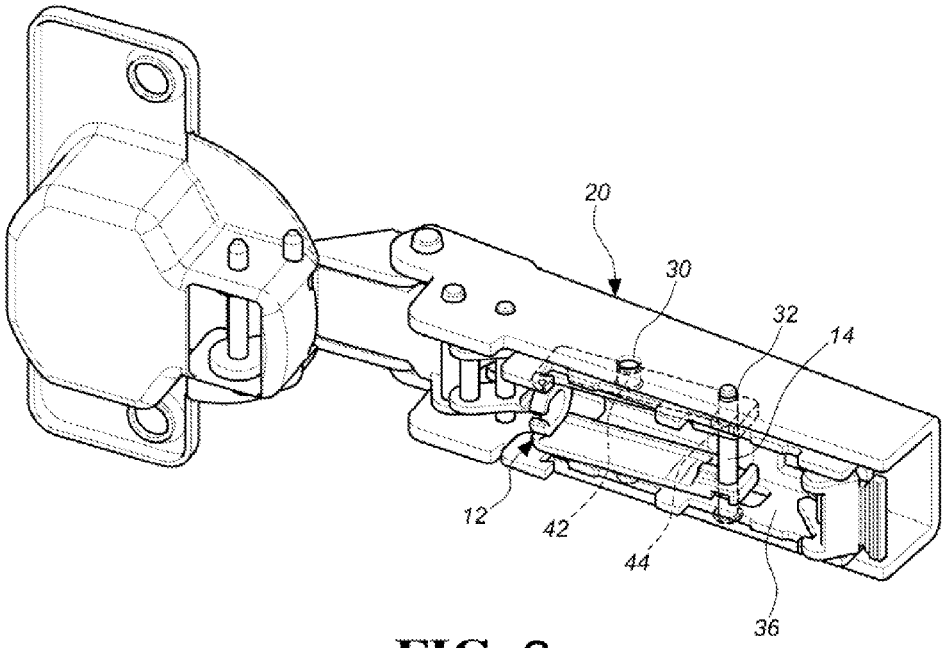
FIG. 3 shows that the securing frame is connected to the hinge unit of the present invention.

The damper 16 comprises a body 54 and a piston 56. The body 54 has a front end portion 58 and a rear end portion 60. The front end portion 58 has a recessed area 62 with which the protrusion 52 of the securing frame 12 is engaged as shown in FIG. 2. The rear end portion 60 has a contact portion 64. In a preferred embodiment, the recessed area 62 of the damper 16 has a tubular portion 66 and the contact portion 64 of the damper 16 is engaged with the engaging portion 46 of the securing frame 12 by an engagement relationship of protrusion and recess.

The damper 16 is a known part which has damping material received therein. The piston 56 is axially movable relative to the body 54 of the damper 16 so as to provide damping force when the piston 56 is axially movable relative to the body 54 of the damper 16. Preferably, a pad 68 is connected to the distal end of the piston 56.

Figure 4:
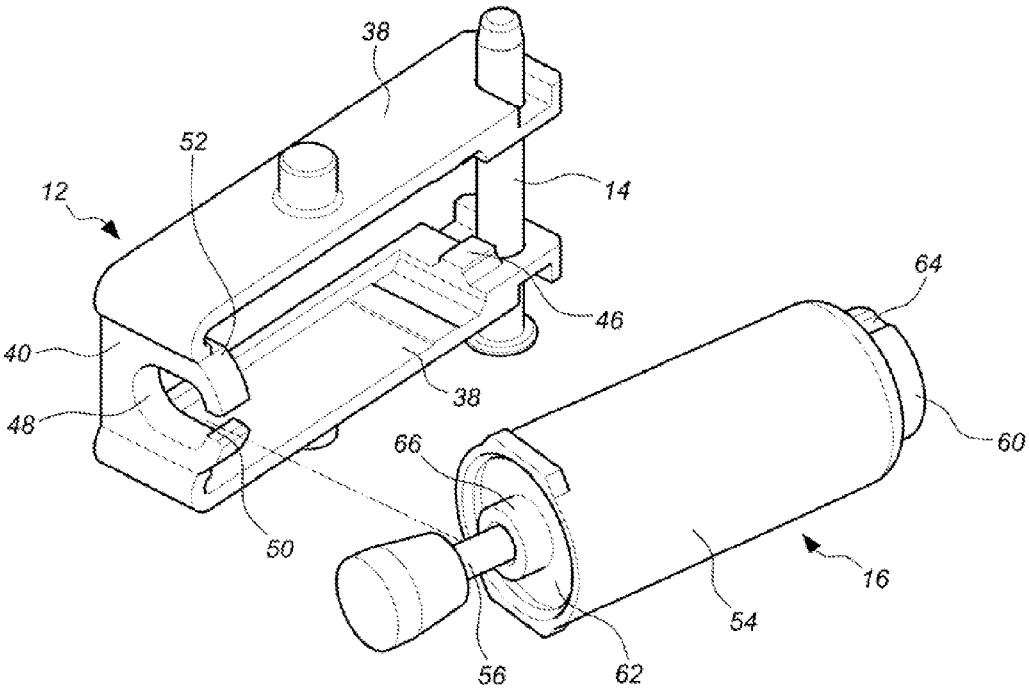
FIG. 4 an exploded view to show the damper and the securing frame of the hinge unit of the present invention.
Figure 5:
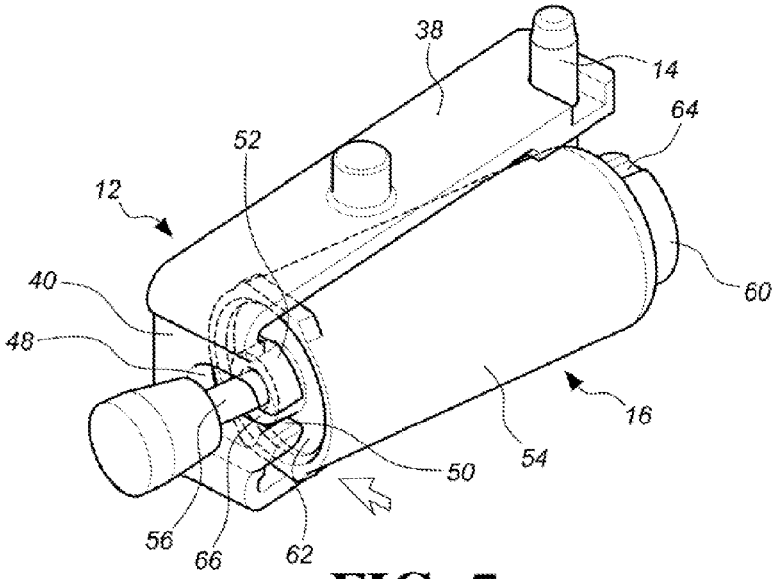
FIG. 5 shows the installation action to connect the damper to the securing frame of the hinge unit of the present invention.
Figure 6:
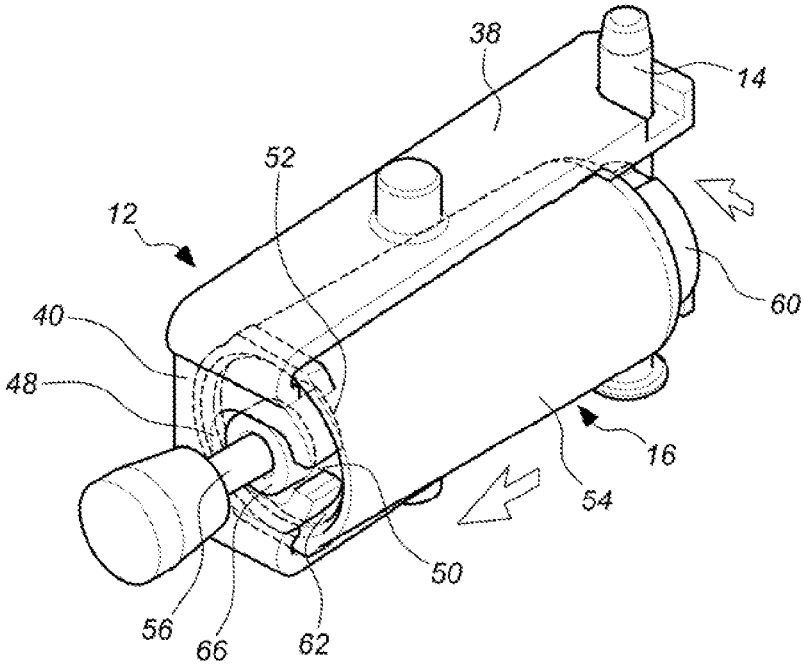
FIG. 6 shows the other installation action to connect the damper to the securing frame of the hinge unit of the present invention.
Figure 7:
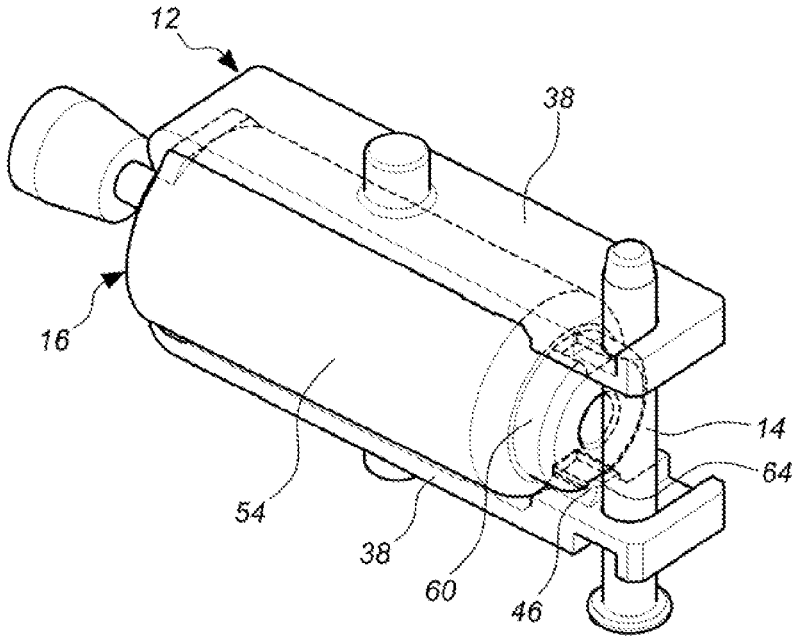
FIG. 7 shows that the damper is installed to the securing frame of the hinge unit of the present invention.

As shown in FIGS. 4 and 5, the piston 56 is inserted into the through hole 48 of the engaging member 40 at an angle via the opening 50 of the securing frame 12, and the recessed area 62 is partially located corresponding to the protrusion 52. The tubular portion 66 is partially located corresponding to the through hole 48 of the engaging member 40. As shown in FIG. 6, by pushing the body 54 of the damper 16 inclinedly relative to the engaging member 40 of the securing frame 12, and the body 54 is engaged between the two side panels 38. The rear end portion 60 of the body 54 contacts the fixing member 14, so that the body 54 of the damper 16 is completely positioned between the two side panels 38 of the securing frame 12, the engaging member 40 and the fixing member 14. The tubular portion 66 of the recessed area 62 extends through the through hole 48 of the engaging member 40, the protrusion 52 is engaged with the recessed area 62, and the contact portion 64 of the rear end portion 60 of the damper 16 contacts the engaging portion 46 of the securing frame 12 as shown in FIG. 7.

Figure 8:
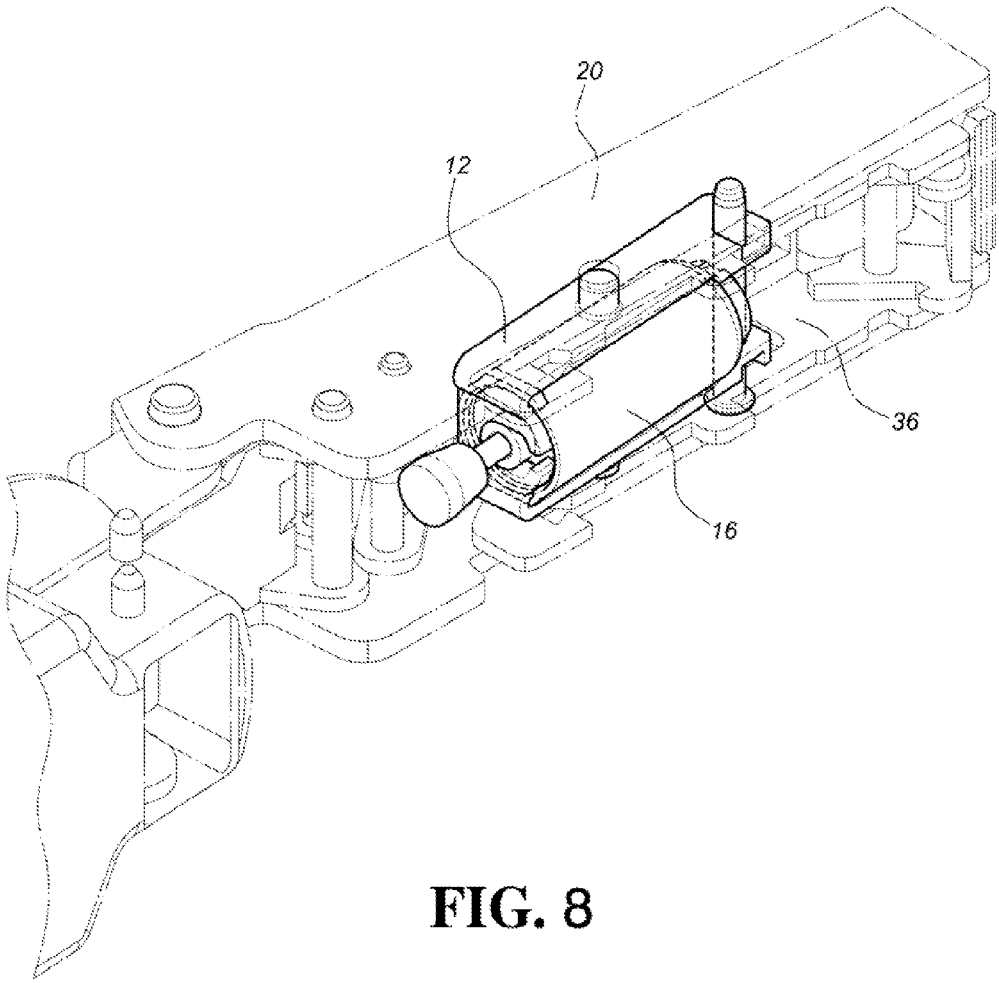
FIG. 8 shows that the damper is installed to the hinge unit of the present invention.

As shown in FIG. 8, the damper 16 is securely positioned in the connection member 36 of the hinge arm 20 by the securing frame 12.

The present invention allows the hinge unit 10 to be cooperated with the damper 16, and the piston 56 moves with a damping force to respond the movement of the hinge arm 20 relative to the hinge base 18.

While we have shown and described the embodiment in accordance with the present invention, it should be clear to those skilled, in the art that further embodiments may be made without departing from the scope of the present invention.

What is claimed is:

1. A hinge unit comprising:

a hinge base having two wings and a housing connected between the two wings;

a hinge arm pivotably connected to the hinge base and having two side walls and a bottom wall connected between the two side walls, each side wall having a first connection hole and a second connection hole, the two side walls and the bottom wall defining a room;

a securing frame having two side panels and an engaging member connected between the two side panels, each of the two side panels having a first connection portion, a second connection portion and an engaging portion, the first connection portion engaged with the first connection hole of the hinge arm, the second connection portion located corresponding to the second connection hole of the hinge arm, the engaging portion located on an inside of the side panels corresponding thereto and being adjacent to the second connection portion, the engaging member having a through hole and a protrusion extending from a periphery of the through hole;

a fixing member extending through the second connection holes of the side walls of the hinge arm and the second connection portions of the side panels of the securing frame so as to connect the securing frame to the hinge arm, and a damper having a body and a piston, the body having a front end portion and a rear end portion, the front end portion having a recessed area and the rear end portion having a contact portion, the piston being axially movable relative to the body of the damper, the damper connected between the two side panels of the securing frame, the piston extending through the through hole of the engaging member, the protrusion of the engaging member engaged with the recessed area of the body, the contact portion of the body contacting the engaging portion of the side panels.

2. The hinge unit as claimed in claim 1, wherein the engaging member of the securing frame has an opening which communicates with the through hole and the protrusion extends toward the engaging portion.

3. The hinge unit as claimed in claim 1, wherein the contact portion of the damper is engaged with the engaging portion of the securing frame by an engagement relationship of protrusion and recess.

4. The hinge unit as claimed in claim 1, wherein the recessed area of the damper has a tubular portion which extends into the through hole of the engaging member.

5. The hinge unit as claimed in claim 1, wherein a connection member is located in the room of the hinge arm and the securing frame is connected in the connection member.

6. The hinge unit as claimed in claim 1, wherein the first connection portion is a protrusion.

7. A hinge unit comprising:

a hinge base having two wings and a housing connected between the two wings;

a hinge arm pivotably connected to the hinge base and having two side walls and a bottom wall connected between the two side walls, each side wall having a first connection hole and a second connection hole, the two side walls and the bottom wall defining a room;

a connection member located in the room of the hinge arm;

a securing frame installed in the room of the hinge arm, the securing frame having two side panels and an engaging member connected between the two side panels, each of the two side panels having a first connection portion, a second connection portion and an engaging portion, the first connection portion being a protrusion and engaged with the first connection hole of the hinge arm, the engaging portion located on an inside of the side panels corresponding thereto and being adjacent to the second connection portion, the engaging member having a through hole and a protrusion extending from a periphery of the through hole;

a fixing member extending through the second connection holes of the side walls of the hinge arm and the second connection portions of the side panels of the securing frame so as to connect the securing frame to the hinge arm, and a damper having a body and a piston, the body having a front end portion and a rear end portion, the front end portion having a recessed area with which the protrusion of the securing frame is engaged, the rear end portion having a contact portion, the piston extending through the through hole of the engaging member and being axially movable relative to the body of the damper, the contact portion of the body contacting the engaging portion of the side panels.

8. The hinge unit as claimed in claim 7, wherein the engaging member of the securing frame has an opening which communicates with the through hole and the protrusion extends toward the engaging portion.

9. The hinge unit as claimed in claim 7, wherein the contact portion of the damper is engaged with the engaging portion of the securing frame by an engagement relationship of protrusion and recess.

10. The hinge unit as claimed in claim 7, wherein the recessed area of the damper has a tubular portion which extends into the through hole of the engaging member.

* * * * *